US010329640B2

(12) United States Patent
Kurisu et al.

(10) Patent No.: US 10,329,640 B2
(45) Date of Patent: Jun. 25, 2019

(54) HEARTH ROLL FOR CONTINUOUS ANNEALING FURNACES, AND METHOD FOR MANUFACTURING SAME

(71) Applicant: NIPPON STEEL & SUMIKIN HARDFACING CO., LTD., Tokyo (JP)

(72) Inventors: Yasushi Kurisu, Tokyo (JP); Yu Li, Tokyo (JP)

(73) Assignee: NIPPON STEEL & SUMIKIN HARDFACING CO., LTD., Tokyo (JP)

( * ) Notice: Subject to any disclaimer, the term of this patent is extended or adjusted under 35 U.S.C. 154(b) by 109 days.

(21) Appl. No.: 15/504,225

(22) PCT Filed: Jun. 29, 2015

(86) PCT No.: PCT/JP2015/003255
§ 371 (c)(1),
(2) Date: Feb. 15, 2017

(87) PCT Pub. No.: WO2016/059736
PCT Pub. Date: Apr. 21, 2016

(65) Prior Publication Data

US 2017/0275730 A1 Sep. 28, 2017

(30) Foreign Application Priority Data

Oct. 17, 2014 (JP) ..... 2014-212984

(51) Int. Cl.
*C21D 9/56* (2006.01)
*C23C 4/18* (2006.01)
(Continued)

(52) U.S. Cl.
CPC ..... *C21D 9/563* (2013.01); *C23C 4/073* (2016.01); *C23C 4/11* (2016.01); *C23C 4/18* (2013.01);
(Continued)

(58) Field of Classification Search
CPC ..... C21D 9/563; C23C 22/30; C23C 22/33; C23C 22/74; C23C 4/073; C23C 4/11; C23C 4/18
(Continued)

(56) References Cited

U.S. PATENT DOCUMENTS 5,070,587 A 12/1991 Nakahira et al.
5,161,306 A * 11/1992 Nakahira ..... B21B 39/008 148/278
(Continued)

FOREIGN PATENT DOCUMENTS

JP S63-100168 A 5/1988
JP H03-75383 A 3/1991
(Continued)

OTHER PUBLICATIONS

PCT, "International Search Report for International Application No. PCT/JP2015/003255".

*Primary Examiner* — Scott R Kastler
*Assistant Examiner* — Michael Aboagye
(74) *Attorney, Agent, or Firm* — Manabu Kanesaka

(57) ABSTRACT

A hearth roll for heat treatment furnaces has excellent build-up resistance, has a hexavalent-chromium-free thermal spray coating film formed on the roll surface thereof and is safe for the environment.

A method for manufacturing a hearth roll for continuous annealing furnaces includes a first step of applying an aqueous solution containing chromium phosphate onto a thermal spray coating film formed on the roll surface of a
(Continued)

hearth roll or impregnating the thermal spray coating film with the aqueous solution; and a second step of burning the hearth roll.

5 Claims, 1 Drawing Sheet

(51) Int. Cl.

| | |
|---|---|
| ***C23C 4/11*** | (2016.01) |
| ***C23C 22/33*** | (2006.01) |
| ***C23C 22/30*** | (2006.01) |
| ***C23C 22/74*** | (2006.01) |
| ***C23C 4/073*** | (2016.01) |

(52) U.S. Cl.
CPC ..... *C23C 22/30* (2013.01); *C23C 22/33* (2013.01); *C23C 22/74* (2013.01)

(58) Field of Classification Search
USPC ..... 266/103; 148/258, 265, 267; 75/237, 75/240, 246; 427/450
See application file for complete search history.

(56) References Cited

U.S. PATENT DOCUMENTS

| | | | | |
|---|---|---|---|---|
| 5,415,702 | A * | 5/1995 | Bishop | C23C 22/08 148/258 |
| 5,976,064 | A * | 11/1999 | Telama | C23C 4/18 29/895.32 |
| 6,858,098 | B2 * | 2/2005 | Oshima | C23C 22/46 148/265 |
| 9,057,133 | B2 * | 6/2015 | Inoue | C23C 22/17 |
| 2005/0109426 | A1 | 5/2005 | Inoue et al. | |

FOREIGN PATENT DOCUMENTS

| | | | |
|---|---|---|---|
| JP | H07-011420 | A | 1/1995 |
| JP | H08-021433 | A | 1/1996 |
| JP | 2003-268562 | A | 9/2003 |
| JP | 2003-293156 | A | 10/2003 |
| JP | 2005-240124 | A | 9/2005 |
| JP | 2006-342398 | A | 12/2006 |
| JP | 2013-104126 | A | 5/2013 |

* cited by examiner

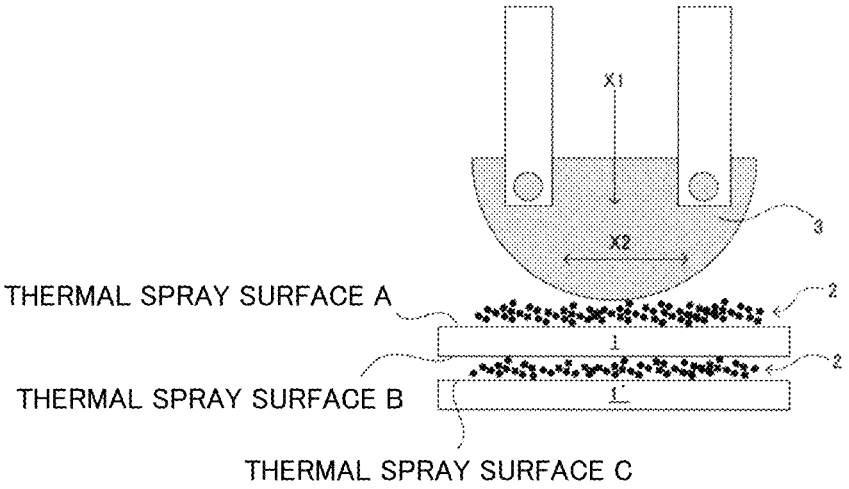
X1
X2
3
THERMAL SPRAY SURFACE A
2
1
2
THERMAL SPRAY SURFACE B
1
THERMAL SPRAY SURFACE C

HEARTH ROLL FOR CONTINUOUS ANNEALING FURNACES, AND METHOD FOR MANUFACTURING SAME

RELATED APPLICATIONS

The present application is National Phase of International Application No. PCT/JP2015/003255 filed Jun. 29, 2015, and claims priority from Japanese Application No. 2014-212984, filed Oct. 17, 2014, the disclosure of which is hereby incorporated by reference herein in its entirety.

TECHNICAL FIELD

The present invention relates to a method for manufacturing a hearth roll for heat treatment furnaces, which is disposed within heat treatment systems and used in continuous annealing lines for band steel sheets or used for annealing and conveying steel sheets, and particularly relates to the build-up resistance of the hearth roll.

BACKGROUND ART

Usually, a hearth roll disposed within continuous heat treatment furnaces continuously anneals and conveys steel sheets having not been subjected to heat treatments for extended time periods under a reduced atmosphere at 500 to 1000° C. Accordingly, the roll surface is abraded, and oxides and iron powder attached to the steel sheets are adhered and deposited on the roll surface. Thus, so-called build-up is often formed.

When unevenness resulting from such abrasion and build-up is generated on the surface of the hearth roll, steel sheets are scratched while being conveyed, causing reduction in quality. For preventing the reduction in quality of steel sheets attributable to the hearth roll, the operation of heat treatment furnaces is periodically interrupted for performing maintenance works such as polishing the hearth roll surface and replacing the roll.

Patent Literature 1 discloses a method including: thermally spraying ceramics or cermets on a metal or alloy coating film formed on the surface of a hearth roll; impregnating the top of this thermal spray layer with an aqueous solution containing chromic acid ($H_2CrO_4$) as a main component to seal the coating film; and subsequently performing a burning treatment to form oxides of various metals and a $Cr_2O_3$ ceramics coating film (see paragraph 0014 in the specification.)

Patent Literature 2 discloses a chromate treatment including: soaking, coating, or spraying a thermal spray coating film formed on the outermost layer of a hearth roll with an aqueous solution containing chromic acid ($H_2CrO_4$); and thereafter performing burning at 350° C. to 550° C. to form a film (see paragraphs 0018, 0021 and the like in the specification). Patent Literature 3 also discloses a chromate treatment which is substantially similar to Patent Literature 2.

CITATION LIST

Patent Literature

Patent Literature 1: JPH8-021433
Patent Literature 2: JP2005-240124
Patent Literature 3: JP2013-104126

SUMMARY OF INVENTION

Technical Problem

Incidentally, the above-described aqueous solution contains hazardous hexavalent chromium. Therefore, a lot of labor and money are required for wastewater treatments. In addition, hexavalent chromium may have adverse effects on the environment and human bodies, and the use thereof is likely to be regulated. The present inventors have conducted research on coating films which have been burned at high temperature. As a result, they have found that part of hexavalent chromium remains in the thermal spray coating film as it is without being transformed into trivalent chromium.

To address such a concern, an object according to the invention of the present application is to provide a hearth roll for heat treatment furnaces, which has excellent build-up resistance, and is safe for the environment with a hexavalent-chromium-free thermal spray coating film formed on the roll surface.

Solution to Problem

In order to solve the above-described problem, the method for manufacturing a hearth roll for heat treatment furnaces according to the invention of the present application is (1) a method for manufacturing a hearth roll for continuous annealing furnaces, including: a first step of applying an aqueous solution containing chromium phosphate onto a thermal spray coating film formed on a roll surface of the hearth roll or impregnating the thermal spray coating film with the aqueous solution; and a second step of burning the hearth roll. The first step allows the aqueous solution to permeate into pores formed in the thermal spray coating film and be attached to the surface of the thermal spray coating film. The second step allows a burned product as a pores-sealing material containing metaphosphoric acid $(PO_3)_n$, a high polymer $(CrPO_4)_n$ and oxides of chromium ($Cr_2O_3$) to be generated inside the pores of the thermal spray coating film. Pores formed in the thermal spray coating film are likely to become starting points for build-up. Therefore, the pores-sealing treatment enables build-up resistance to be enhanced. Also, this burned product is a firm inorganic amorphous substance having many cyclic structures in which metaphosphoric acid $(PO_3)_n$ and a high polymer $(CrPO_4)_n$ are crosslinked. Thus, the pores-sealing treatment can be performed with $CrPO_4$ and $Cr_2O_3$, which have excellent build-up resistance and are safe for the environment unlike hexavalent chromium. Also, oxides of chromium ($Cr_2O_3$) can be fixed by the cyclic structures of $(PO_3)_n$ as a cyclic compound and a high polymer $(CrPO_4)_n$. Therefore, the adhering ability with the thermal spray coating film is higher than that of chromium oxides ($Cr_2O_3$) particles formed by the burning treatment of a chromium solution such as solutions of chromic acid ($H_2CrO_4$), chromium sulfate ($Cr_2(SO_4)_3$), chromium chloride ($CrCl_3$), and chromium nitrate ($Cr(NO_3)_3$). Consequently, dropping-off in an early stage attributable to abrasion and thermal impact can be suppressed. The second step allows the coating film containing $(PO_3)_n$, $(CrPO_4)_n$ and $Cr_2O_3$ to be further formed on the surface of the thermal spray coating film. Accordingly, the surface of the thermal spray coating film can be coated with $(CrPO_4)_n$ and $Cr_2O_3$, which have excellent build-up resistance and are safe for the environment unlike hexavalent chromium.

Here, the aqueous solution may contain, other than chromium phosphate, harmless elements, such as Si, Zr, B, N, and C.

Furthermore, the aqueous solution may contain a surfactant. The inclusion of the surfactant enables chromium phosphate to permeate into deeper positions of pores (that is, an interface between the thermal spray layer and the roll main body). The concentration of the surfactant is preferably not less than 0.001% and less than 1%. When the concentration of the surfactant is less than 0.001%, the above-described effect cannot be sufficiently obtained. When the concentration of the surfactant is 1% or more, the above-described effect is saturated, and a surplus surfactant is carbonized and drops off after having been burned, thereby reducing the pores-sealing effect of the thermal spray coating film.

The burning temperature is preferably 250° C. to 700° C. When the burning temperature is lower than 250° C., moisture remains in the roll. When the burning temperature is higher than 700° C., oxidation of the roll main body and the thermal spray coating film is promoted.

(2) In the configuration of the above-described (1), when the amount of the aforementioned aqueous solution is 100% by mass, the concentration of chromium phosphate is preferably 5% by mass to 30% by mass, and the concentration of chromium (the chromium concentration in chromium phosphate) is preferably 1.5% by mass to 15% by mass. When the concentration of chromium phosphate is less than 5% by mass, the amounts of phosphoric acid and chromium oxides which are generated by the burning of the aqueous solution become excessively small. Thus, the pores-sealing treatment to the thermal spray coating film becomes insufficient. On the other hand, when the concentration of chromium phosphate is more than 30% by mass, the viscosity of the aqueous solution becomes excessively high. Thus, permeation into the thermal spray coating film deteriorates, thereby reducing the pores-sealing effect to the whole thermal spray coating film. When the concentration of chromium contained in the aqueous solution is 1.5% by mass or less, the concentration of chromium oxides contained in the generated burned product becomes 15% by mass or less, thereby reducing build-up resistance. When the concentration of chromium contained in the aqueous solution is 15% by mass or more, the concentration of chromium oxides contained in the generated burned product becomes 45% by mass or more, while the decrease in the adhering ability attributable to the reduction of phosphorus-containing oxides causes chromium oxides to be likely to drop off. Thus, build-up resistance is reduced.

(3) In the configuration of the above-described (1) or (2), the burning may be performed once in the second step. Although chromium phosphate shrinks in volume by burning, the shrinkage is small. Therefore, high pores-sealing effect can be obtained by performing the pores-sealing treatment once. That is, when the shrinkage when burned is large, the pores-sealing treatment needs to be repeated. However, according to the chromium phosphate-containing aqueous solution of the present invention, high pores-sealing effect can be obtained by performing the pores-sealing treatment once. Also, a coating film including a highly dense burned product can be formed on the thermal spray coating film by performing the burning treatment once.

(4) The hearth roll for continuous annealing furnaces according to the invention of the present application is a hearth roll for continuous annealing furnaces which includes a thermal spray coating film on a roll surface, wherein pores of the thermal spray coating film are sealed by a burned product obtained by burning an aqueous solution containing chromium phosphate, and the coating film surface of the thermal spray coating film is covered with the burned product.

(5) In the configuration of the above-described (4), when the amount of the burned product is 100% by mass, the chromium concentration is preferably 15% by mass to 45% by mass, and the remainder includes a thermal spray coating film component and an oxide containing phosphorus. Here, the concentration of the burned product is obtained by measuring a concentration distribution through the observation of approximately 10 cross-sectional structures of the burned product in the thermal spray coating film or on the surface thereof in a sample cross section of the thermal spray coating film having been subjected to the burning treatment, using an electron probe micro analyser (EPMA).

(6) In the above-described (4) or (5), the burned product which covers the coating film surface of the thermal spray coating film desirably has a thickness of 2 to 20 μm. When the thickness is less than 2 μm, reactants such as Fe and Mn oxides are likely to transmit through the burned product to react with the thermal spray coating film. Therefore, build-up resistance may be reduced. When the thickness is more than 20 μm, the burned product is likely to drop off. Therefore, build-up resistance may be reduced.

Advantageous Effects of Invention

According to the invention of the present application, there can be provided a hearth roll for heat treatment furnaces, which has excellent build-up resistance, has a hexavalent-chromium-free thermal spray coating film and is safe for the environment.

BRIEF DESCRIPTION OF DRAWINGS

FIG. 1 is a schematic view of a measurement device for measuring MN values.

DESCRIPTION OF EMBODIMENTS

The present invention will be more specifically described with reference to examples.

(Hexavalent Chromium Measurement Test)

An aqueous solution of chromic acid (comparative examples) placed in a ceramic container was burned to generate burned powder. The contents of chromium and hexavalent chromium in 2.5 g of this burned powder were measured, and the concentration of hexavalent chromium was calculated. Similarly, an aqueous solution of chromium phosphate (examples) placed in a ceramic container was burned to generate burned powder. The contents of chromium and hexavalent chromium in 2.5 g of this burned powder were measured, and the concentration of hexavalent chromium was calculated. The burning time was 3 hours. The burning was performed once. The burning temperature was 410° C. in Comparative Example 1, 460° C. in Comparative Example 2, 500° C. in Comparative Example 3, 600° C. in Comparative Example 4, 700° C. in Comparative Example 5, 410° C. in Example 1, 500° C. in Example 2, 600° C. in Example 3, and 700° C. in Example 4. The contents of chromium and hexavalent chromium were measured by diphenyl carbazide absorptiometry. The used measurement device was U-2000 double-beam spectrophotometer manufactured by Hitachi. The burned powder of Comparative Example 1 was black. The burned powders of Comparative Examples 2 and 3 were dark green. The burned powders of Comparative Examples 4 and 5 were bright green. All of the burned powders of Examples 1 to 4 were bright green. When the concentration of hexavalent chromium was 1000 ppm (0.1% by mass) or less, the evaluation "good" was given indicating that the content of hexavalent chromium is low. When the concentration of hexavalent chromium was more than 1000 ppm (0.1% by mass), the evaluation "poor" was given indicating that the content of hexavalent chromium is high.

TABLE 1

| | COMPARATIVE EXAMPLE 1 | COMPARATIVE EXAMPLE 2 | COMPARATIVE EXAMPLE 3 | COMPARATIVE EXAMPLE 4 | COMPARATIVE EXAMPLE 5 |
|---|---|---|---|---|---|
| BURNING TEMPERATURE | 410° C. | 460° C. | 500° C. | 600° C. | 700° C. |
| Cr CONTENT mg/kg(=ppm) | 6400 | 8000 | 8000 | 7600 | 7500 |
| HEXAVALENT CHROMIUM CONTENT mg/kg(=ppm) | 6400 | 7700 | 7800 | 7200 | 7300 |
| EVALUATION RESULTS | poor | poor | poor | poor | poor |

TABLE 2

| | EXAMPLE 1 | EXAMPLE 2 | EXAMPLE 3 | EXAMPLE 4 |
|---|---|---|---|---|
| BURNING TEMPERATURE | 410° C. | 500° C. | 600° C. | 700° C. |
| Cr CONTENT mg/kg(=ppm) | LESS THAN 5 | LESS THAN 5 | LESS THAN 5 | LESS THAN 5 |
| HEXAVALENT CHROMIUM CONTENT mg/kg(=ppm) | LESS THAN 5 | LESS THAN 5 | LESS THAN 5 | LESS THAN 5 |
| EVALUATION RESULTS | good | good | good | good |

As illustrated in Table 1, all of Comparative Examples 1 to 5 were evaluated as "poor" indicating that the content of hexavalent chromium was high. As illustrated in Table 2, all of Examples 1 to 4 were evaluated as "good" indicating that the content of hexavalent chromium was low. It is noted that the detection limit of the measurement device used for measuring the concentrations was 5 ppm. All of the concentrations of Examples were less than the detection limit.

(Build-Up Resistance Test)

A prescribed sample was prepared, and measured for the MN value and the Fe attachment amount to evaluate build-up resistance. FIG. 1 is a schematic view of a measurement device for measuring MN values. As illustrated in FIG. 1, a thermal spray test piece 1 and a thermal spray test piece 1' were stacked, and a build-up material 2 was placed therebetween (that is, between a thermal spray surface B and a thermal spray surface C). The build-up material 2 was also dispersed on a thermal spray surface A that is the upper surface of the thermal spray test piece 1. Then, reciprocating motions in an arrow X2 direction were performed while applying a load by pressing a half-moon-shaped roll 3 against the thermal spray surface A in an arrow X1 direction, thereby to evaluate the build-up states of the respective thermal spray surfaces A to C.

The test was performed with the temperatures and environmental conditions indicated in Table 3. The thermal spray surfaces A to C were formed with CoCrAlY-based (47% Co-17% Cr-10% Al-1% Y-25% $Cr_2O_3$ in terms of % by mass) cermet thermal spray coating films.

Each of the thermal spray surfaces A to C was evaluated on the basis of the total of points given according to the attachment state of build-up. When turning the thermal spray test pieces 1 and 1' to the vertical direction caused the build-up material 2 to drop, three points were given indicating very favorable build-up resistance. When rubbing with gauze caused the build-up material 2 to drop, two points were given indicating mostly favorable build-up resistance. When rubbing with forceps caused the build-up material 2 to drop, one point was given indicating poor build-up resistance. When any of the above methods did not cause the build-up material 2 to drop, zero points were given indicating extraordinarily poor build-up resistance.

After the above-described reciprocating motions of the half-moon-shaped roll 3 were performed, the amounts of Fe attached to the thermal spray surfaces A to C were measured using a fluorescent X-ray measurement device, and the average value thereof was calculated. The test results are illustrated in Table 4. When the MN value was more than 7, and the Fe attachment amount was 2% by mass or less, the evaluation "very good" was assigned, indicating extraordinarily favorable build-up resistance. When the MN value was more than 4 and not more than 7, the evaluation "good" was assigned regardless of the Fe attachment amount, indicating favorable build-up resistance. When the MN value was 4 or less, the evaluation "poor" was assigned, indicating poor build-up resistance.

TABLE 3

| ITEMS | CONDITIONS |
|---|---|
| TEMPERATURE(° C.) | 1000° C. |
| ATMOSPHERE | 96% $N_2$—4% $H_2$ |
| LOAD(kg) | 10 |
| BUILD-UP MATERIAL | $Fe_3O_4$ |

TABLE 4

| | THERMAL SPRAY COATING FILM | COMPOSITION OF AQUEOUS SOLUTION (% by mass) | FREQUENCY OF BURNING | Cr CONTENT OF BURNED PRODUCT (% by mass) | THICKNESS OF BURNED PRODUCT (μm) | MN VALUE | Fe ATTACH-MENT AMOUNT (% by mass) | EVALU-ATION |
|---|---|---|---|---|---|---|---|---|
| EXAMPLE 5 | CoCrAlY-BASED CERMETS | 8% AQUEOUS SOLUTION OF CHROMIUM PHOSPHATE 15% AS Cr | ONCE | 45% | 8 | 8.5 | 0.90% | very good |
| EXAMPLE 6 | CoCrAlY-BASED CERMETS | 10% AQUEOUS SOLUTION OF CHROMIUM PHOSPHATE + 0.05% SURFACTANT 13% AS Cr | ONCE | 42% | 13 | 9.0 | 0.50% | very good |
| EXAMPLE 7 | CoCrAlY-BASED CERMETS | 5% AQUEOUS SOLUTION OF CHROMIUM PHOSPHATE + 0.05% SURFACTANT 11% AS Cr | ONCE | 38% | 3 | 8.9 | 0.60% | very good |
| EXAMPLE 8 | CoCrAlY-BASED CERMETS | 8% AQUEOUS SOLUTION OF CHROMIUM PHOSPHATE 15% AS Cr | ONCE | 43% | 10 | 7.9 | 0.60% | very good |
| EXAMPLE 9 | CoCrAlY-BASED CERMETS | 30% AQUEOUS SOLUTION OF CHROMIUM PHOSPHATE 5% AS Cr | ONCE | 16% | 18 | 8.1 | 0.50% | very good |
| EXAMPLE 10 | CoCrAlY-BASED CERMETS | 30% AQUEOUS SOLUTION OF CHROMIUM PHOSPHATE + 0.05% SURFACTANT 9% AS Cr | ONCE | 23% | 19 | 8.8 | 0.50% | very good |
| REFERENCE EXAMPLE 1 | CoCrAlY-BASED CERMETS | 3% AQUEOUS SOLUTION OF CHROMIUM PHOSPHATE 10% AS Cr | ONCE | 36% | 1 | 4.6 | 5.30% | good |
| REFERENCE EXAMPLE 2 | CoCrAlY-BASED CERMETS | 10% AQUEOUS SOLUTION OF CHROMIUM PHOSPHATE + 0.0001% SURFACTANT 0.5% AS Cr | ONCE | 12% | 9 | 5.0 | 4.50% | good |
| REFERENCE EXAMPLE 3 | CoCrAlY-BASED CERMETS | 10% AQUEOUS SOLUTION OF CHROMIUM PHOSPHATE + 1.1% SURFACTANT 0.9% AS Cr | ONCE | 14% | 13 | 5.0 | 3.70% | good |
| REFERENCE EXAMPLE 4 | CoCrAlY-BASED CERMETS | 40% AQUEOUS SOLUTION OF CHROMIUM PHOSPHATE + 0.05% SURFACTANT 16% AS Cr | ONCE | 51% | 23 | 4.3 | 5.30% | good |
| COMPARATIVE EXAMPLE 5 | CoCrAlY-BASED CERMETS | 15% AQUEOUS SOLUTION OF CHROMIUM SULFATE 20% AS Cr | TWICE | 26% | 13 | 3.3 | 5.10% | poor |
| COMPARATIVE EXAMPLE 6 | CoCrAlY-BASED CERMETS | 23% AQUEOUS SOLUTION OF CHROMIUM CHLORIDE 26% AS Cr | TWICE | 31% | 16 | 3.1 | 5.90% | poor |
| COMPARATIVE EXAMPLE 7 | CoCrAlY-BASED CERMETS | 17% AQUEOUS SOLUTION OF CHROMIUM NITRATE 8% AS Cr | TWICE | 23% | 15 | 3.4 | 6.30% | poor |
| COMPARATIVE EXAMPLE 8 | CoCrAlY-BASED CERMETS | 15% AQUEOUS SOLUTION OF CHROMIC ACID 9% AS Cr | TWICE | 56% | 10 | 3.0 | 4.60% | poor |

TABLE 4-continued

| | THERMAL SPRAY COATING FILM | COMPOSITION OF AQUEOUS SOLUTION (% by mass) | FREQUENCY OF BURNING | Cr CONTENT OF BURNED PRODUCT (% by mass) | THICKNESS OF BURNED PRODUCT (μm) | MN VALUE | Fe ATTACH-MENT AMOUNT (% by mass) | EVALU-ATION |
|---|---|---|---|---|---|---|---|---|
| COMPARATIVE EXAMPLE 9 | CoCrAlY-BASED CERMETS | 24% AQUEOUS SOLUTION OF CHROMIC ACID 15% AS Cr | TWICE | 53% | 12 | 3.9 | 6.80% | poor |
| COMPARATIVE EXAMPLE 10 | CoCrAlY-BASED CERMETS | 15% AQUEOUS SOLUTION OF CHROMIC ACID 9% AS Cr | FOUR TIMES | 55% | 8 | 4.2 | 5.50% | good |
| COMPARATIVE EXAMPLE 11 | CoCrAlY-BASED CERMETS | 24% AQUEOUS SOLUTION OF CHROMIC ACID 15% AS Cr | FOUR TIMES | 54% | 17 | 4.3 | 4.90% | good |

In Examples 5 to 10, the MN value was more than 7, and the Fe attachment amount was 2% by mass or less. Therefore, the build-up resistance was evaluated as "very good." That is, since Examples 5 to 10 satisfied a chromium phosphate concentration of 5% by mass to 30% by mass and a chromium concentration of 1.5% by mass to 15% by mass, which are preferable conditions of the present invention, the evaluation for build-up resistance became "very good." In Reference Example 1, the Fe attachment amount increased due to the low chromium phosphate concentration. However, the MN value was more than 4. Therefore, the build-up resistance was evaluated as "good." In Reference Example 2, since the low surfactant concentration led to the reduced permeation of the aqueous solution into the thermal spray coating film, the Fe attachment amount increased. However, the MN value was more than 4. Therefore, the build-up resistance was evaluated as "good." In Reference Example 3, since the concentration of a surfactant was excessively high, the surfactant was carbonized and dropped off after burned, and the Fe attachment amount increased. However, the MN value was more than 4. Therefore, the build-up resistance was evaluated as "good." In Reference Example 4, although preferable conditions of the present invention were not satisfied, the MN value was more than 4. Therefore, the build-up resistance was evaluated as "good." In Comparative Examples 5 to 7, an aqueous solution of trivalent chromium salt was used instead of an aqueous solution of chromium phosphate. Therefore, sealing effect to the thermal spray coating film was low, and the Fe attachment amount increased. The MN value was 4 or less. Therefore, the build-up resistance was evaluated as "poor." In Comparative Examples 8 to 9, the MN value was 4 or less. Therefore, the build-up resistance was evaluated as "poor".

As apparent from the above-described tests, the build-up resistance was improved by the pores-sealing treatment with the aqueous solution of chromium phosphate compared to the case by a known pores-sealing treatment with an aqueous solution of chromic acid. That is, it was found that the hearth roll according to the invention of the present application is safe for the environment in terms of the absence of hexavalent chromium, and has extraordinarily excellent build-up resistance. Furthermore, it was found that the build-up resistance is drastically improved by satisfying preferable conditions of the present invention (chromium phosphate concentration: 5% by mass to 30% by mass, chromium concentration: 1.5% by mass to 15% by mass). It is noted that the present inventor conducted tests similar to the above-described tests by using MnO instead of $Fe_3O_4$ as the build-up material 2, and confirmed that results mostly similar to the above-described results were obtained.

Furthermore, in the examples, extraordinarily high build-up resistance was obtained by performing the burning treatment (that is, the applying step and the burning step) once. On the other hand, in Comparative Examples 5 to 9, sufficient build-up resistance was not obtained even by performing the burning treatment twice. Also, as illustrated in Comparative Examples 10 toll, the burning treatment had to be performed four times for raising the evaluation for build-up resistance from "poor" to "good."

REFERENCE SIGNS LIST

1, 1': thermal spray test piece
2: build-up material
3: half-moon-shaped roll

The invention claimed is:

1. A method for manufacturing a hearth roll for continuous annealing furnaces, comprising:

a first step of applying an aqueous solution containing chromium phosphate onto a thermal spray coating film formed on a roll surface of the hearth roll; and a second step of burning the hearth roll, wherein the thermal spray coating film is a CoCrAlY-based cermet thermal spray coating film, and when an amount of the aqueous solution is 100% by mass, a concentration of chromium phosphate is 5% by mass to 30% by mass, and a concentration of chromium in the chromium phosphate is 1.5% by mass to 15% by mass.

2. The method for manufacturing a hearth roll for continuous annealing furnaces according to claim 1, wherein the burning is performed once in the second step.

3. The method for manufacturing a hearth roll for continuous annealing furnaces according to claim 1, further comprising a step of forming the thermal spray coating film on the roll surface of the hearth roll before the first step of applying the aqueous solution containing the chromium phosphate onto the thermal spray coating film, wherein in the first step of applying the aqueous solution, the aqueous solution is permeated into pores formed in the thermal spray coating film and is attached to a surface of the thermal spray coating film, in the second step of burning the hearth roll, a burned product containing a metaphosphoric acid, a high polymer and oxides of chromium is generated inside the pores of the thermal spray coating film and on the surface of the thermal spray coating film, and the burned product does not include a hexavalent-chromium.

4. The method for manufacturing a hearth roll for continuous annealing furnaces according to claim 3, wherein the aqueous solution contains a surfactant, and a concentration of the surfactant is no less than 0.001% and less than 1%.

5. The method for manufacturing a hearth roll for continuous annealing furnaces according to claim 4, wherein in the second step of burning the hearth roll, a burning temperature is between 250° C. and 700° C.

* * * * *